US006658225B2

(12) United States Patent
Thompson et al.

(10) Patent No.: US 6,658,225 B2
(45) Date of Patent: Dec. 2, 2003

(54) NON-UNIFORM PRE-CHARGE ERASE ARRAY WITH RELATIVELY UNIFORM OUTPUT

(75) Inventors: David M. Thompson, Fairport, NY (US); Ed Savage, Webster, NY (US); Franly H. Sanchez, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 14 days.

(21) Appl. No.: 10/084,496

(22) Filed: Feb. 28, 2002

(65) Prior Publication Data

US 2003/0161659 A1 Aug. 28, 2003

(51) Int. Cl.[7] ..... G03G 21/00
(52) U.S. Cl. ..... 399/128; 399/186; 399/187

(58) Field of Search ..... 399/127, 128, 399/186, 187

(56) References Cited

U.S. PATENT DOCUMENTS 4,576,464 A * 3/1986 Sakata et al. ..... 399/186
4,734,734 A * 3/1988 Yano ..... 399/186
4,963,933 A * 10/1990 Brownlee ..... 399/186
5,030,992 A * 7/1991 Yoneda et al. ..... 399/186
5,272,504 A * 12/1993 Omura et al. ..... 399/187 X

* cited by examiner

*Primary Examiner*—William J. Royer
(74) *Attorney, Agent, or Firm*—Oliff & Berridge, PLC

(57) ABSTRACT

An image forming system including a charge pre-charge erase array system that includes a plurality of pint light sources that emit a band of light onto a photoreceptor. The plurality of point light sources are variably spaced to substantially uniformly illuminate the photoreceptor.

13 Claims, 9 Drawing Sheets

NON-UNIFORM PRE-CHARGE ERASE ARRAY WITH RELATIVELY UNIFORM OUTPUT

BACKGROUND OF THE INVENTION

1. Field of Invention

This invention relates to image forming systems that incorporate light sensitive photoreceptors.

2. Description of Related Art

Generally, electrophotographically forming an image includes charging a photoconductive member, photoreceptor or photoconductor to a substantially uniform potential. This sensitizes the photoconductive surface of the photoconductive member. The charge portion of the photoconductive surface is then exposed to a light image from either a modulated light source or from light reflected from an original document being reproduced. This creates an electrostatic latent image on the photoconductive surface.

After the electrostatic latent image is created on the photoconductive surface, the latent image is developed. During development, toner particles are electrostatically attracted to the latent image recorded on the photoconductive surface. The toner particles form a developed image on the photoconductive surface. The developed image is then transferred to a copy sheet. Subsequently, the toner particles and the developed image are heated to permanently fuse the toner particles to the copy sheet.

After the developed image is transferred from the photoconductive surface, the photoconductive surface is ideally clean and fully discharged and thus ready for another charge, exposure and development cycle. Unfortunately, the photoconductor in actual image forming devices is neither clean nor fully discharged at this point. Rather, residual charge and untransferred toner remain on the photoconductor, which need to be removed.

This is accomplished in part by exposing the photoconductor using a pre-charge erase light source to fully discharge the photoconductor. FIGS. 10 and 11 illustrate a plurality of point light sources 510, 520, 530, 540 located within a conventional pre-charge erase light source 502. As shown in FIGS. 10 and 11, the centers of the point light sources 510, 520, 530 and 540 are placed at a fixed distance x from each other. Each point light source 510, 520, 530 and 540 emits a beam of light onto the photoreceptor 500. As shown in FIG. 10, the light intensity for point light sources 510, 520, 530 and 540 is indicated by curves 512, 522, 532, 542, respectively. As should be appreciated, the intensity of light is greatest at a point on the photoreceptor 500 closest to the individual point light sources 510, 520, 530 and 540 and decreases at points farther away from the point light sources 510, 520, 530 and 540.

The total light intensity at a given point on the photoreceptor 500 is the sum of the light intensities from the point light sources 510, 520, 530 and 540 overlapping light intensity curves 512, 522, 532 and 542. As shown with respect to a first point 550, the total light intensity only includes the light emitted from point light source 520, as neither of the light intensity curves 512 nor 532 overlaps the light intensity curve 522 at the first point 550. However, at a second point 560, the total light intensity includes the light intensity from point light sources 520 and 530 as indicated by overlapping shown using the light intensity curves 522 and 532.

SUMMARY OF THE INVENTION

As should be appreciated, the total light intensity at the second point 560 is greater than the total light intensity at the first point 550. This occurs, as shown using the light intensity curves 522 and 532, because the light intensity at the second point 560 supplied by each of the light sources 510 and 520 is closer to the maximum light intensity than the minimum light intensity for a single light source. The closer to the maximum light intensity, the light intensity at the second point 560 from each light source 510 and 520, the larger the difference in the total light intensity between point 550 and 560. Thus, large fluctuations in this total light intensity occur along the axis of photoreceptor 500 due to these differences in light intensity. This results in an uneven light intensity distribution on the photoreceptor 500.

This invention provides systems and methods to maintain a relatively uniform distribution of light on the photoreceptor.

The invention separately provides systems and methods that produce an energy of light in the range of 20–40 njoules/mm$^2$.

The invention separately provides systems and methods that produce light energy distribution on the photoreceptor having a 2:1 max/min ratio.

This invention separately provides systems and methods that uniformly distributes the light energy while reducing the cost of providing a plurality of light emitting devices.

This invention separately provides systems and methods that determine an amount of energy placed on a photoreceptor from a single light source.

This invention separately provides systems and methods that vary the spacing between light source elements to optimize uniformity among a plurality of the light sources.

In various exemplary embodiments of the systems and methods for forming and/or operating a pre-charge erase array to obtain a relatively uniform output distribution, uniform output distribution is created by determining the amount of light placed on the photoreceptor. By determining the amount of light on the photoreceptor, a plurality of point light sources are positioned such that the light intensity remains relatively uniform along the photoreceptor. In various exemplary embodiments of the systems and methods according to this invention, by appropriately spacing the point light sources based on the determined light intensity, the amount of point light sources used can be reduced at the same time a uniform light distribution is created.

These and other features and advantages of this invention are described in or are apparent from the following detailed description of various exemplary embodiments of the apparatuses, systems and methods of this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

For simplicity and clarification, the operating principles, design factors, and layout of the pre-charge erase array systems and methods according to this invention are explained with reference to various exemplary embodiments of the pre-charge erase array systems and methods according to this invention, as shown in FIGS. 1–9. The basic explanation of the operation of the illustrated pre-charge erase array systems and methods is applicable for the understanding and design of the constituent components employed in the pre-charge erase array systems and methods of this invention.

Figure 1:
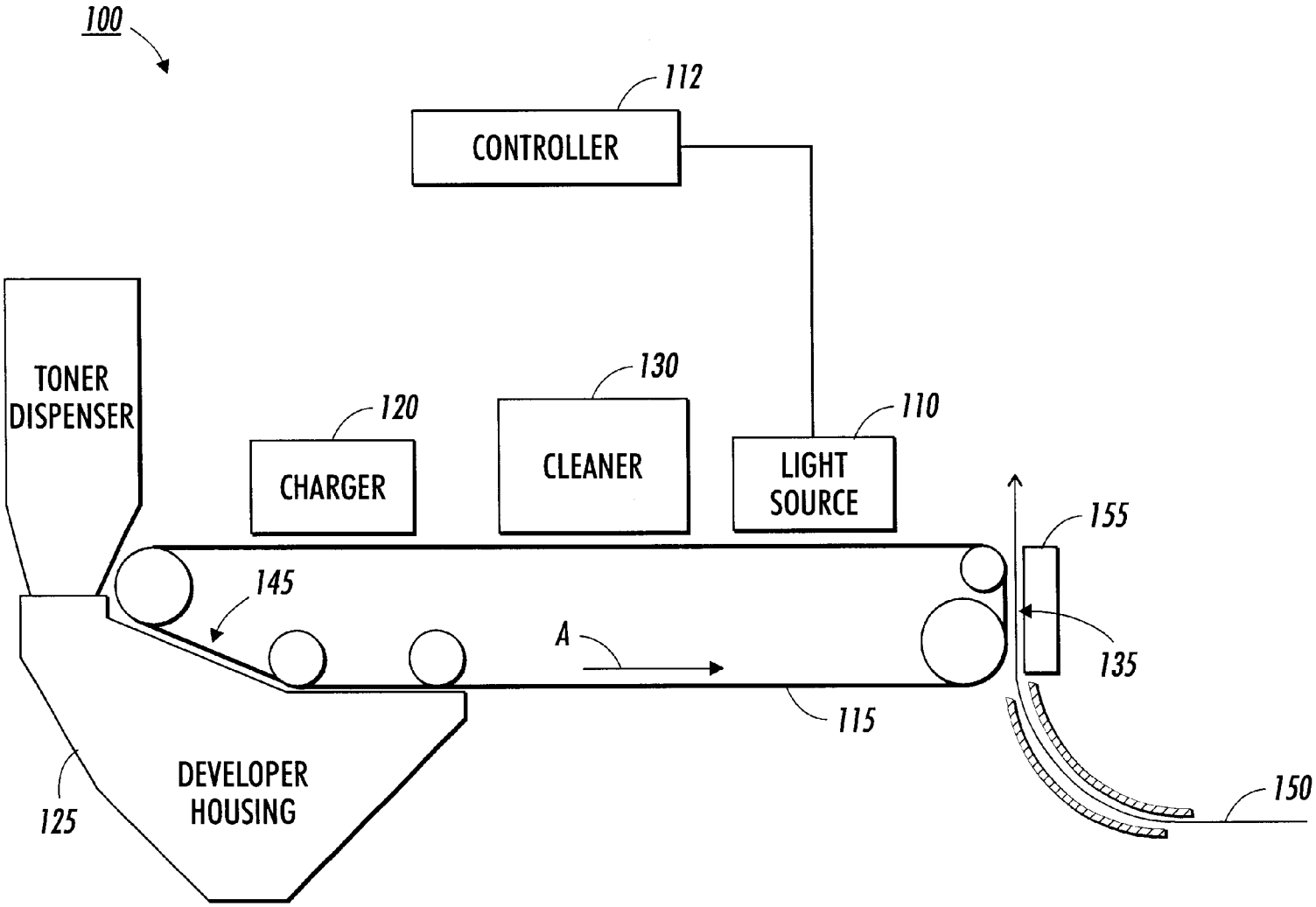
FIG. 1 is a side view showing the structure of an image forming system incorporating a first exemplary embodiment of a pre-charge erase array system according to this invention.

FIG. 1 shows an image forming system incorporating a first exemplary embodiment of a pre-charge erase array system 110 according to this invention. As shown in FIG. 1, the pre-charge erase array system 110 is one element of a belt-type image forming system 100. The pre-charge erase array system 110 is positioned adjacent to a photoreceptor 115 and connected to a controller 112. In various exemplary embodiments, the pre-charge erase array system 110 includes a plurality of point light sources, such as LEDs, laser diodes and the like. The photoreceptor 115 is a belt-type device that rotates in the direction A, and advances sequentially through various xerographic process steps.

A cleaner 130 is mounted adjacent to the photoreceptor 115 downstream of the pre-charge erase array system 110. The cleaner 130 removes residual toner particles from the surface of the photoreceptor 115 after the developed image is transferred to an image recording medium from the photoreceptor 115 and after the photoreceptor 115 is discharged by the pre-charge erase array system 110. A charger 120 is mounted adjacent to the photoreceptor 115 downstream of the cleaner 130. The charger 120 charges the photoreceptor 115 to a predetermined potential and polarity. A toner dispenser/developer housing 125 is also mounted adjacent to the photoreceptor 115. The toner dispenser/developer housing 125 creates a latent image on, stores toner particles and dispenses the toner particles to, the photoreceptor 115 to develop the latent image in an imaging/exposure/developing zone 145. A transfer dicorotron 155 is also mounted adjacent to the photoreceptor 115. The area between the transfer dicorotron 155 and the photoreceptor 115 forms an image transfer zone 135.

As should be appreciated, each point light source within the pre-charge erase array system 110 may be an LED, a laser diode or any other known or later-developed light emitting structure. Further, each point light source may emit radiation in the ultra-violet, visible and/or near infrared regions of the electromagnetic spectrum. However, it should be appreciated that any currently available or later developed light source can be used in the pre-charge erase array system 110 to emit a highly directional beam of light onto the photoreceptor 115.

If the pre-charge erase array system 110 includes multiple modes, the controller 112 is used to control which mode is active and to controllably turn on and off the light sources within the pre-charge erase array system 110. However, if the pre-charge erase array system 110 does not have either multiple modes or a mode that requires controllably turning on and off the pre-charge erase array system 110, the controller 112 can be omitted. It should be appreciated that the controller 112 can be implemented as an independent control device or as a portion of the main controller of the image forming system 100 in which the pre-charge erase array system 110 is implemented.

During operation of the image forming system 100, as a portion of photoreceptor 115 passes by the charger 120, the charger 120 charges the photoconductive surface of photoreceptor 115 to a relatively high, substantially uniform potential $V_0$. Next, the charged portion of the photoconductive surface of photoreceptor 115 advances through the imaging/exposure/developing zone 145. In the imaging/exposure/developing zone 145, portions of the photoconductive surface of photoreceptor 115 are selectively discharged to form a latent electrostatic image. This latent image is then developed on the photoconductive surface of the photoreceptor 115.

The photoreceptor 115, which is initially charged to a voltage $V_0$ by the charger 120, undergoes dark decay to a voltage level $V_{dd}$. In various exemplary embodiments, the dark decay voltage $V_{dd}$ is equal to about −500V. When developed at the imaging/exposure/developing zone 145, the exposed portions of the photoreceptor 115 are discharged to an exposure voltage $V_e$. In various exemplary embodiments, the exposure voltage $V_e$ is equal to about −50V. Thus, after exposure, the photoreceptor 115 has a bipolar voltage profile of high and low voltages. In various exemplary embodiments, the high voltages correspond to charged areas and the low voltages correspond to discharged or background areas. Thus, the photoreceptor 115 now has an electrostatic latent image formed on the surface of the photoreceptor 115.

As the photoreceptor 115 continues to move, the imaged portion of the photoreceptor 115 passes the toner dispenser/developer housing 125. The toner dispenser/developer housing 125 transfers charged toner particles to the imaged portions of the photoreceptor 115.

As the photoreceptor 115 continues to move, the developed image arrives at the image transfer zone 135. In the image transfer zone 135, a recording medium moves along a sheet path 150 in a timed sequence so that the developed image developed on the surface of the photoreceptor 115 contacts the advancing recording medium at image transfer zone 135.

In various exemplary embodiments of the image forming system 110, the image transfer zone 135 includes the transfer dicorotron 155, which applies a bias to the recording medium. In various exemplary embodiments, the transfer dicorotron 155 sprays positive ions onto the backside of the recording medium. This attracts the charged toner particles of the developed image from the surface of the photoreceptor 115 to the recording medium.

After transfer, the recording medium continues to move along the sheet path 150. The recording medium is separated from the photoconductive surface of the photoreceptor 115. Then, the recording medium continues to move along the sheet path 150. A fusing station permanently affixes the toner particles of the transferred image to the recording medium.

As the photoreceptor 115 continues to move, the photoreceptor 115 passes the pre-charge erase array system 110.

The pre-charge erase system 110 shines high-intensity light onto the photoreceptor 115 to remove any residual charge on the photoreceptor 115 onto the photoreceptor 115, the high-intensity light from the pre-charge erase array system 110 neutralizes any remaining charge remaining from the charges placed on the surface of the photoreceptor 115 by the charger 120. Thus, any remaining charged toner particles carried on the photoconductive surface of the photoreceptor 115 will no longer be as strongly attracted to the surface of the photoreceptor 115. As the photoreceptor 115 continues to move, the photoreceptor 115 passes the cleaner 130. Because any remaining charged toner particles carried on the photoconductive surface of the photoreceptor 115 will no longer be as strongly attracted to the surface of the photoreceptor 115, the cleaner 130 is able to more easily remove any remaining toner particles from the surface of the photoreceptor 115.

In various exemplary embodiments, a plurality of point light sources may be oriented to expose a portion of the photoreceptor 115 to the high-intensity light as that portion of the photoreceptor 115 travels past the pre-charge erase array system 110.

Figure 2:
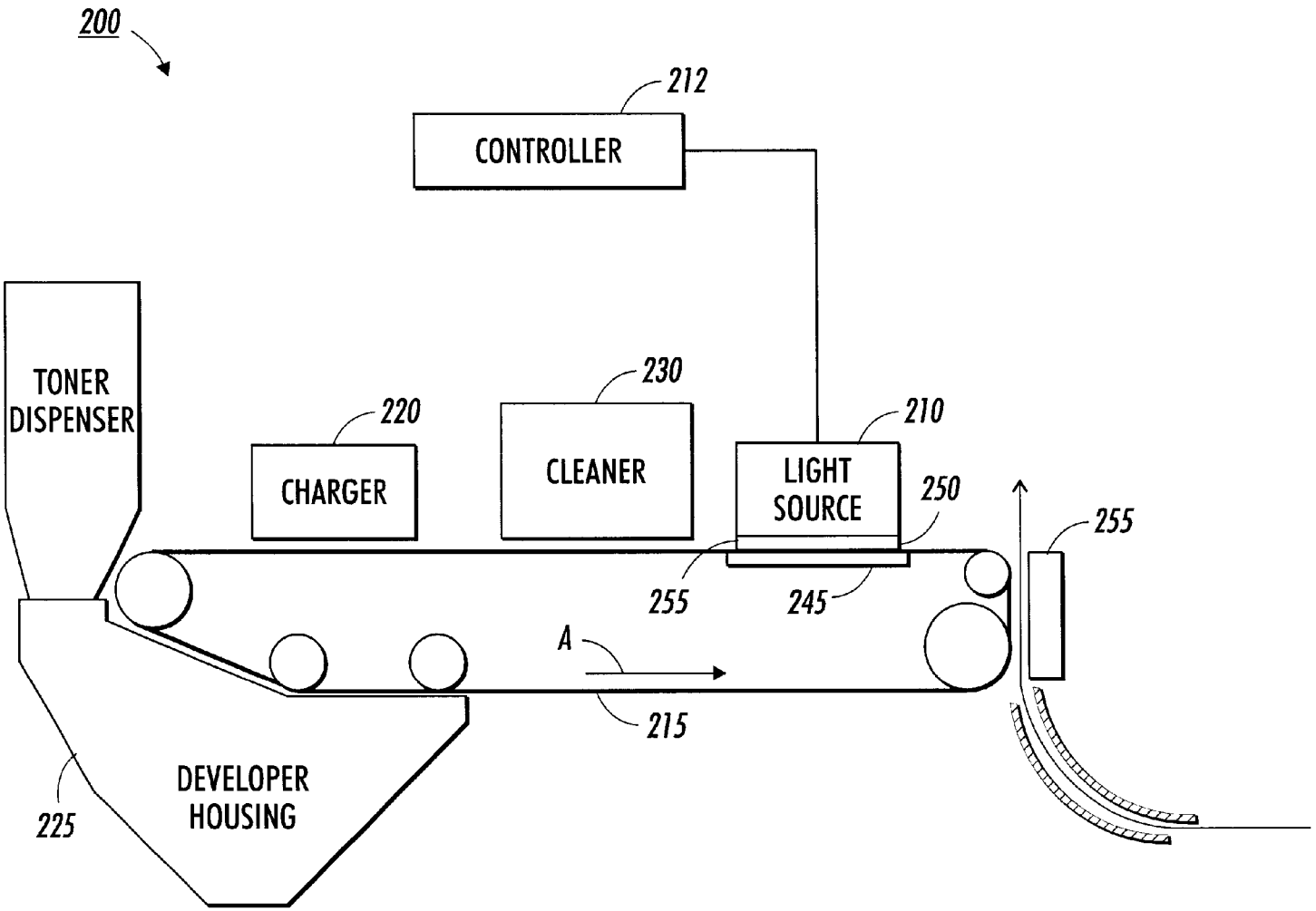
FIG. 2 is a side view showing the structure of an image forming system incorporating a second exemplary embodiment of a pre-charge erase array system according to this invention.

FIG. 2 shows an image forming system 200 incorporating a second exemplary embodiment of a pre-charge erase array system 210. As illustrated in FIG. 2, pre-charge erase array system 210 is connected to a controller 212 and is positioned relative to a photoreceptor 215, a charger 220, a toner dispenser/developer housing 225, a cleaner 230, and a transfer dicorotron 255. Each of these elements is generally similar to the corresponding elements discussed above with respect to FIG. 1. In FIG. 2, the photoreceptor 215 is a belt-type device that rotates in the direction A.

However, pre-charge erase array system 210 further includes a number of light sealing elements 245, 250 and 255. The light sealing elements 250 and 255 are attached to a housing of the pre-charge erase array system 210. The light sealing element 245 is positioned on the side of the photoreceptor 215 opposite the pre-charge erase array system 210. The light sealing elements 245, 250 and 255 are positioned to reduce, if not prevent, any stray light from the pre-charge erase array system 210 from entering other areas of the imaging forming system. In various exemplary embodiments, at least one of the light sealing elements 245, 250 and 255 has a reflective surface where the reflective surface faces the photoreceptor 215. In various exemplary embodiments, the reflective surface of at least one of the light sealing elements 245, 250 and 255 reflects light from the pre-charge erase array system 210 toward the photoreceptor 215.

If the pre-charge erase array system 210 includes multiple modes, the controller 212 is used to control which mode is active and to controllably turn on and off the pre-charge erase array system 210. However, if the pre-charge erase system 210 does not have either multiple modes or a mode that requires controllably turning on and off the pre-charge erase array system 210, the controller 212 can be omitted. It should be appreciated that the controller 212 can be implemented as an independent control device or as a portion of the main controller of the image forming system 200 in which the pre-charge erase array system 210 is implemented.

Figure 3:
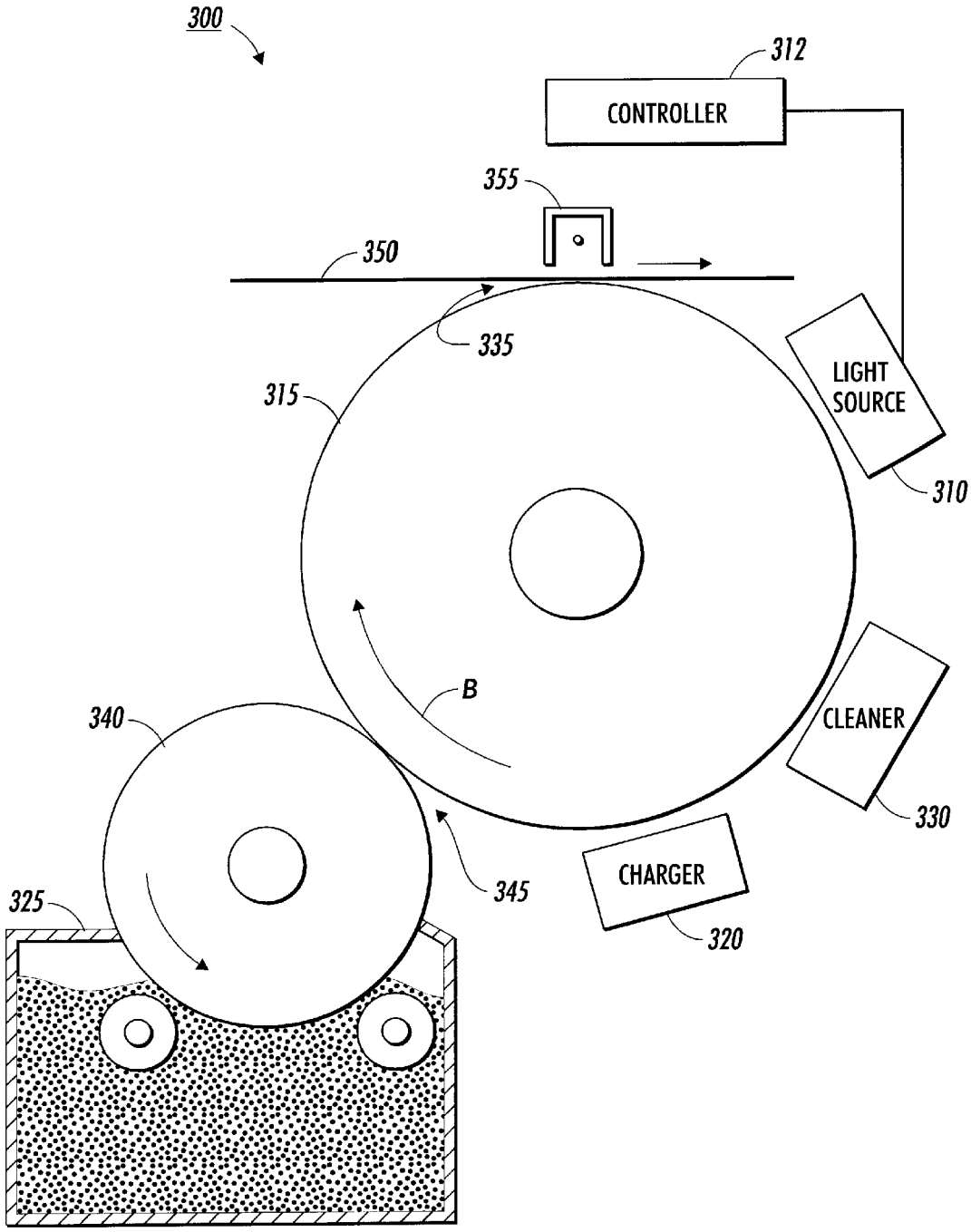
FIG. 3 is a side view showing the structure of an image forming system incorporating a third exemplary embodiment of a pre-charge erase array system according to this invention.

FIG. 3 shows an image forming system 300 incorporating a third exemplary embodiment of a pre-charge erase array system 310 according to this invention. As illustrated in FIG. 3, the pre-charge erase array system 310 is positioned adjacent to a drum-type photoreceptor 315 and a controller 312. In various exemplary embodiments, the pre-charge erase array system 310 includes a plurality of point light sources, such as LEDs, laser diodes and the like. The photoreceptor 315 is a drum-type device that rotates in the direction B and advances sequentially through various xerographic process steps.

A charger 320 is mounted adjacent to the photoreceptor 315. The charger 320 charges the photoreceptor 315 to a predetermined potential and polarity. An imaging and developing system 325 is also mounted adjacent to the photoreceptor 315. The imaging and developing system 325 creates a latent image on the photoreceptor 315 and stores and dispenses toner particles to the photoreceptor 315 to develop the latent image. A transfer dicorotron 355 is also mounted adjacent to the photoreceptor 315. The area between the transfer dicorotron 355 and the photoreceptor 315 forms an image transfer zone 335. A cleaner 330 is also mounted adjacent to the photoreceptor 315 downstream of the pre-charge erase array system 310. The cleaner 330 removes residual toner particles from the surface of the photoreceptor 315 after the developed image is transferred to an image recording medium from the photoreceptor 315 and after the photoreceptor 315 is discharged by the pre-charge erase array system 310.

The pre-charge erase array system 310, the photoreceptor 315, the charger 320, the image and developing system 325, the cleaner 330, and the transfer dicorotron 355 correspond to and operate similarly to the same elements discussed above with respect to FIGS. 1 and/or 2.

If the pre-charge erase array system 310 includes multiple modes, the controller 312 is used to control which mode is active and to controllably turn on and off the light sources of the pre-charge erase array system 310. However, if the pre-charge erase array system 310 does not have either multiple modes or a mode that requires controllably turning on and off the light sources, the controller 312 can be omitted. It should be appreciated that the controller 312 can be implemented as an independent control device or as a portion of the main controller of the image forming system 300 in which the pre-charge erase array system 310 is implemented.

During operation of the image forming system 300 according to this invention, as a portion of the photoreceptor 315 rotates by the charger 320, the charger 320 charges the photoconductive surface of photoreceptor 315 to a relatively high, substantially uniform potential $V_0$. Next, the charged portion of the photoconductive surface of photoreceptor 315 rotates through an imaging/exposure/developing zone 345. In imaging/exposure/developing zone 345, portions of the photoconductive surface of the photoreceptor 315 are selectively discharged by the imaging and developing system 325 to form a latent electrostatic image. This latent image is then developed on the photoconductive surface of photoreceptor 315 by the imaging and developing system 325.

The photoreceptor 315, which is initially charged to a voltage $V_0$ by charger 320, undergoes dark decay to a voltage level $V_{dd}$. In various exemplary embodiments, the dark decay voltage $V_{dd}$ is equal to about −500V. When exposed at the imaging/exposure/developing zone 345, the exposed portions of the photoreceptor 315 are discharged to an exposure voltage $V_e$ In various exemplary embodiments, the exposure voltage $V_E$ is equal to about −50V. Thus, after exposure, the photoreceptor 315 has a bipolar voltage profile of high and low voltages. In various exemplary embodiments, the high voltages correspond to charged areas and the low voltages correspond to discharged or background areas. Thus, the photoreceptor 315 now has an electrostatic latent image formed on the surface of the photoreceptor 315.

As the photoreceptor 315 continues to rotate, the imaged portion of the photoreceptor 315 passes the imaging and developing system 325. The image and developing system 325 transfers charged toner particles to the imaged portions of the photoreceptor 315 using a transfer roller 340.

As the photoreceptor 315 continues to rotate, the developed image arrives at the image transfer zone 335. In the image transfer zone 335, a recording medium moves along a sheet path 350 in a timed sequence so that the developed image developed on the surface of the photoreceptor 315 contacts the advancing recording medium in the image transfer zone 335.

In various exemplary embodiments of the image forming system 300, the image transfer zone 335 includes a transfer dicorotron 355, which applies a bias to the recording medium. In various exemplary embodiments, the transfer dicorotron 355 sprays positive ions onto the backside of the recording medium. This attracts the charged toner particles of the developed image from the surface of the photoreceptor 315 to the recording medium.

As the photoreceptor 315 continues to rotate, the photoreceptor 315 passes the pre-charge erase array system 310. The pre-charge erase system 310 shines high-intensity light onto the photoreceptor 315.

In various exemplary embodiments, the light from the pre-charge erase array system 310 neutralizes any remaining charges remaining on the surface of the photoreceptor 315. Thus, any remaining charged toner particles carried on the photoconductive surface of the photoreceptor 315 will no longer be as strongly attracted to the surface of the photoreceptor 315. As the photoreceptor 315 continues to rotate, the photoreceptor 315 passes the cleaner 330. Because any remaining charged toner particles carried on the photoconductive surface of the photoreceptor 315 will no longer be as strongly attracted to the surface of the photoreceptor 315, the cleaner 330 more easily removes any remaining toner particles from the surface of the photoreceptor 315.

In other exemplary embodiments, the pre-charge erase array system 310 may include the light sealing elements discussed above with respect to FIG. 2.

In various exemplary embodiments, a plurality of point light sources expose a portion of the photoreceptor 315 to the high-intensity light before that portion of the photoreceptor 315 travels past the cleaner 330.

Figure 4:
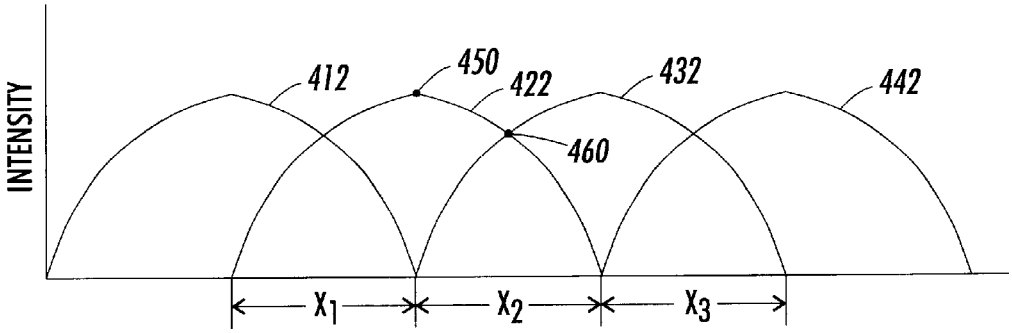
FIG. 4 is a graph illustrating the light intensity from a plurality of light sources along the photoreceptor.
Figure 5:
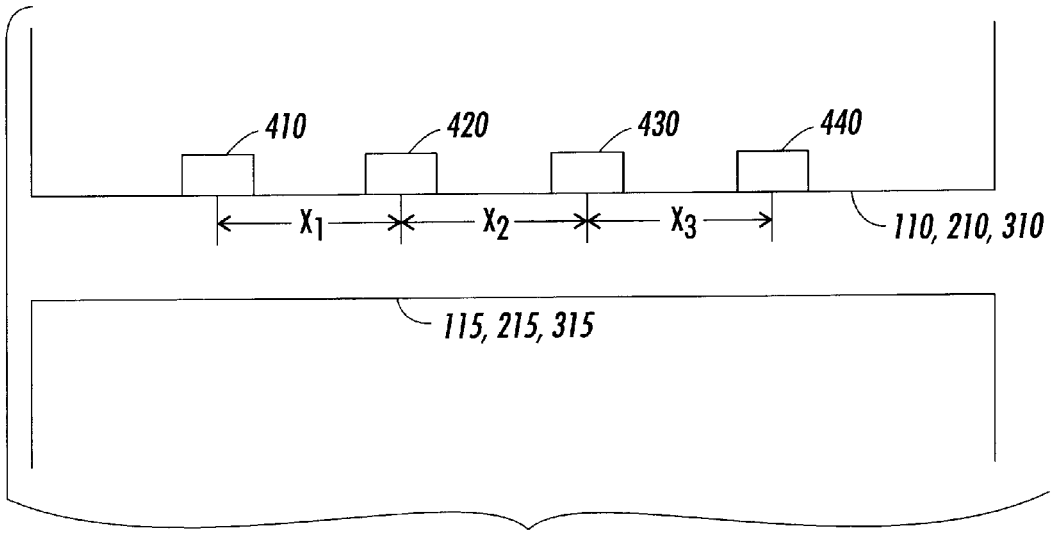
FIG. 5 shows a plurality of light sources placed adjacent to a photoreceptor.

FIG. 5 illustrates a plurality of point light sources 410, 420, 430 and 440 located within one of the pre-charge erase array systems 110, 210, or 310 placed adjacent to the photoreceptor 115, 215 or 315. FIG. 4 illustrates the distribution of light intensity on the photoreceptor 115, 215 or 315. As shown in FIGS. 4 and 5, the centers of the point light sources 410, 420, 430 and 440 are placed at a variable distance $x_i$ (i=1, 2, 3, . . . ) from each other. When a beam of light is transmitted from one of the point light sources 410, 420, 430 or 440 to the photoreceptor 115, 215, 315, the intensity of light is shown by the light intensity curves 412, 422, 432 or 442, respectively. As should be appreciated, the intensity of the light is the greatest at a point on the photoreceptor 115, 215, 315 that is closest to the point light source 410, 420, 430 or 440 and decreases for points on the photoreceptor 115, 215 or 315 that is farther away from that point light source 410, 420, 430 or 440.

As should be appreciated, the total light intensity at a given point is the sum of the light intensities from overlapping light beams from the light sources 410, 420, 430 and 440, which is represented by the overlapping light intensity curves 412, 422, 432, and 442. As shown relative to a first point 450 or the photoreceptor 115, 215 or 315, the total light intensity includes only the light transmitted by the point light source 420. At a second point 460 on the photoreceptor 115, 215 or 315, the total light intensity includes the light intensity from the point light sources 420 and 430.

To reduce the difference in light intensity between the first and second points 450 and 460, the inventors have determined an amount of energy placed on a photoreceptor from a single point light source. Based on the amount of energy placed on the photoreceptor by the point light source, the inventors were thus able to space the point light sources such that the fluctuations in the minimum and maximum light intensity is reduced.

To reduce the fluctuation between the minimum and maximum light intensity on the photoreceptor, the invention thus provides the following three-dimensional expression to determine the amount of energy placed at a given point on the photoreceptor by a given point light source:

$$E:(x,y,z)=B \cos \alpha_i \cos \beta_i/R_i^2 \quad (1)$$

where

B is the brightness of the point light source;

$\alpha$ is the angle between the surface normal to the photoreceptor and the vector to the point light source;

$\beta$ is the angle between the surface normal to the point light source and the vector to the photoreceptor;

i is the ith source illuminating the surface; and

R is the distance from the point light source to the photoreceptor.

In various exemplary embodiments, when the point light source and the photoreceptor are parallel, such that the photoreceptor surface normal passes through the point light source, y and z are constant. Thus, when the point light sources are aligned, $\cos \alpha_i$ is equal to $\cos \beta_i$. As such, the three-dimensional expression to determine the amount of energy placed on a photoreceptor by a given point light source can be determined as follows:

$$E(x)=NB\Sigma \cos^2 \alpha_i/R_i^2 \quad (2)$$

where

N is equal to the number of point light sources located within the pre-charge erase array system;

$\alpha_i$ is equal to $\mathrm{Arctan}[(x_i-x)/K]$;

K is equal to the separation between the point light source and the photoreceptor;

$x_i$ is equal to the lateral offset between point x on the photoreceptor and the ith point light source; and $1/R_i$ is equal to the $\cos \alpha_i/K$.

In various exemplary embodiments, when determining the three-dimensional expression to determine the amount of energy placed on a photoreceptor by a given point light source while using a lens, the following equation is used:

$$E(x)=MNB\Sigma \cos^j \alpha_i \cos \beta_i/R_i^2 \quad (3)$$

where

M is equal to the on-axis output relative to the same point light source without the lens; and $\cos^j \alpha_i$ is a power function that approximates output profile defined by the supplier so that a 50% output matches the angle specified by the supplier.

Figure 6:
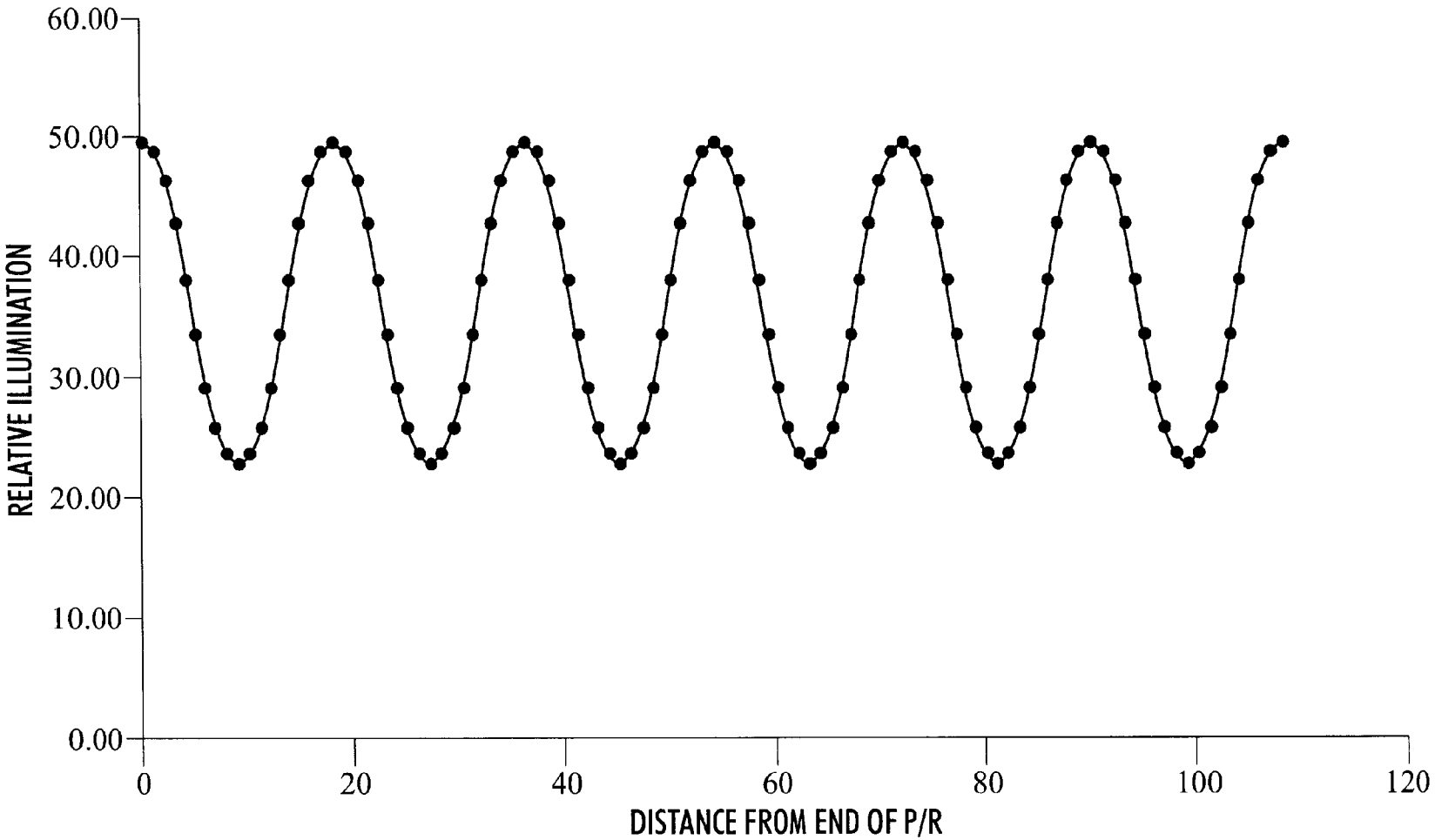
FIGS. 6–9 each show a graph illustrating the light intensity from a different arrangement of a plurality of light sources arranged along the photoreceptor.

Table 1 below outlines the general specifications that can be used to obtain the total light intensity curve shown in FIG. 6.

TABLE 1

| X@P/R | S1 0 | S2 18 | S3 36 | S4 54 | S5 72 | S6 90 | S7 108 | . . . | S13 216 | E(x) |
|---|---|---|---|---|---|---|---|---|---|---|
| 0.000 | 49.18 | 0.33 | 0.00 | 0.00 | 0.00 | 0.00 | 0.00 | | 0.00 | 49.513 |
| 1.000 | 48.24 | 0.52 | 0.00 | 0.00 | 0.00 | 0.00 | 0.00 | | 0.00 | 48.760 |
| 2.000 | 45.54 | 0.80 | 0.00 | 0.00 | 0.00 | 0.00 | 0.00 | | 0.00 | 46.340 |
| 3.000 | 41.39 | 1.23 | 0.00 | 0.00 | 0.00 | 0.00 | 0.00 | | 0.00 | 42.619 |
| 4.000 | 36.25 | 1.86 | 0.00 | 0.00 | 0.00 | 0.00 | 0.00 | | 0.00 | 38.117 |
| . . . | | | | | | | | | | |
| 105.000 | 0.00 | 0.00 | 0.00 | 0.00 | 0.00 | 1.23 | 41.39 | | 0.00 | 42.703 |
| 106.000 | 0.00 | 0.00 | 0.00 | 0.00 | 0.00 | 0.80 | 45.54 | | 0.00 | 46.473 |
| 107.000 | 0.00 | 0.00 | 0.00 | 0.00 | 0.00 | 0.52 | 48.24 | | 0.00 | 48.971 |
| 108.000 | 0.00 | 0.00 | 0.00 | 0.00 | 0.00 | 0.33 | 49.18 | | 0.00 | 49.845 |

Conventional Spacing

As shown in Table 1, using e.g., (3), the design specifications for the light intensity output requires a narrow angle lens with a 50% fall-off at 15°, where j=20, the relative output on the axis compared to the same LED without lens (M) to be 1, and 12 (N) uniformly spaced point light sources at a distance of 24.40 mm (R) away from the photoreceptor. As should be appreciated, with the above uniform spacing a maximum/minimum ratio between the highest total light intensity and lowest total light intensity is 2.4. Thus, FIG. 6 illustrates the deficiencies of the fixed spacing based on the conventional pre-charge erase array systems.

Figure 7:
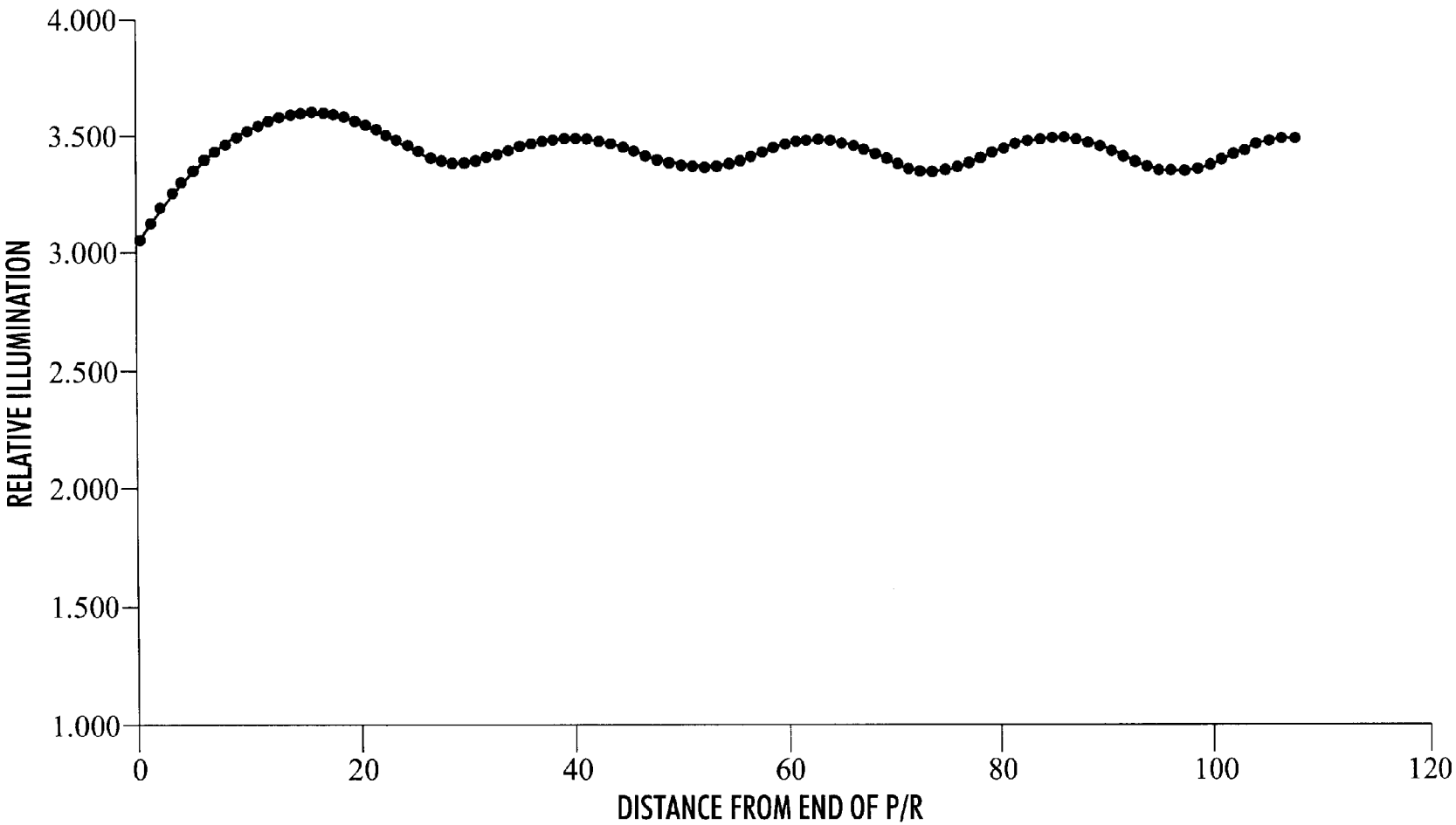

Table 2 outlines the general specifications usable to obtain the total light intensity curve shown in FIG. 7.

TABLE 2

| X @ P/R | S1 0 | S2 18.0 | S3 40.5 | S11 216.0 | E(x) |
|---|---|---|---|---|---|
| 0 | 2.02 | 0.85 | 0.14 | 0.00 | 3.059 |
| 1 | 2.01 | 0.91 | 0.15 | 0.00 | 3.134 |
| 2 | 1.99 | 0.99 | 0.17 | 0.00 | 3.201 |
| 3 | 1.96 | 1.06 | 0.18 | 0.00 | 3.260 |
| 4 | 1.91 | 1.14 | 0.19 | 0.00 | 3.312 |
| 105 | 0.01 | 0.01 | 0.03 | 0.00 | 3.464 |
| 106 | 0.01 | 0.01 | 0.03 | 0.00 | 3.474 |
| 107 | 0.00 | 0.01 | 0.03 | 0.00 | 3.481 |
| 108 | 0.00 | 0.01 | 0.03 | 0.00 | 3.483 |

General Specifications for the Sample Light Intensity Output According to this Invention As shown in Table 2, using e.g., (3), the design specifications for one exemplary embodiment of a pre-charge erase array system according to this invention does not require any lens, where j=1, the relative output on the axis compared to the same LED without lens (M) to be 1, and 11 (N) point light sources with variable spacing were the point light sources are spaced at a distance of 24.40 mm (R) away from the photoreceptor. As should be appreciated, with the above spacing a maximum/minimum ratio between the highest light intensity and lowest light intensity is 1.05 Thus, FIG. 7 illustrates the improvements obtainable using a variable spacing pre-charge erase array system according to this invention.

Figure 8:
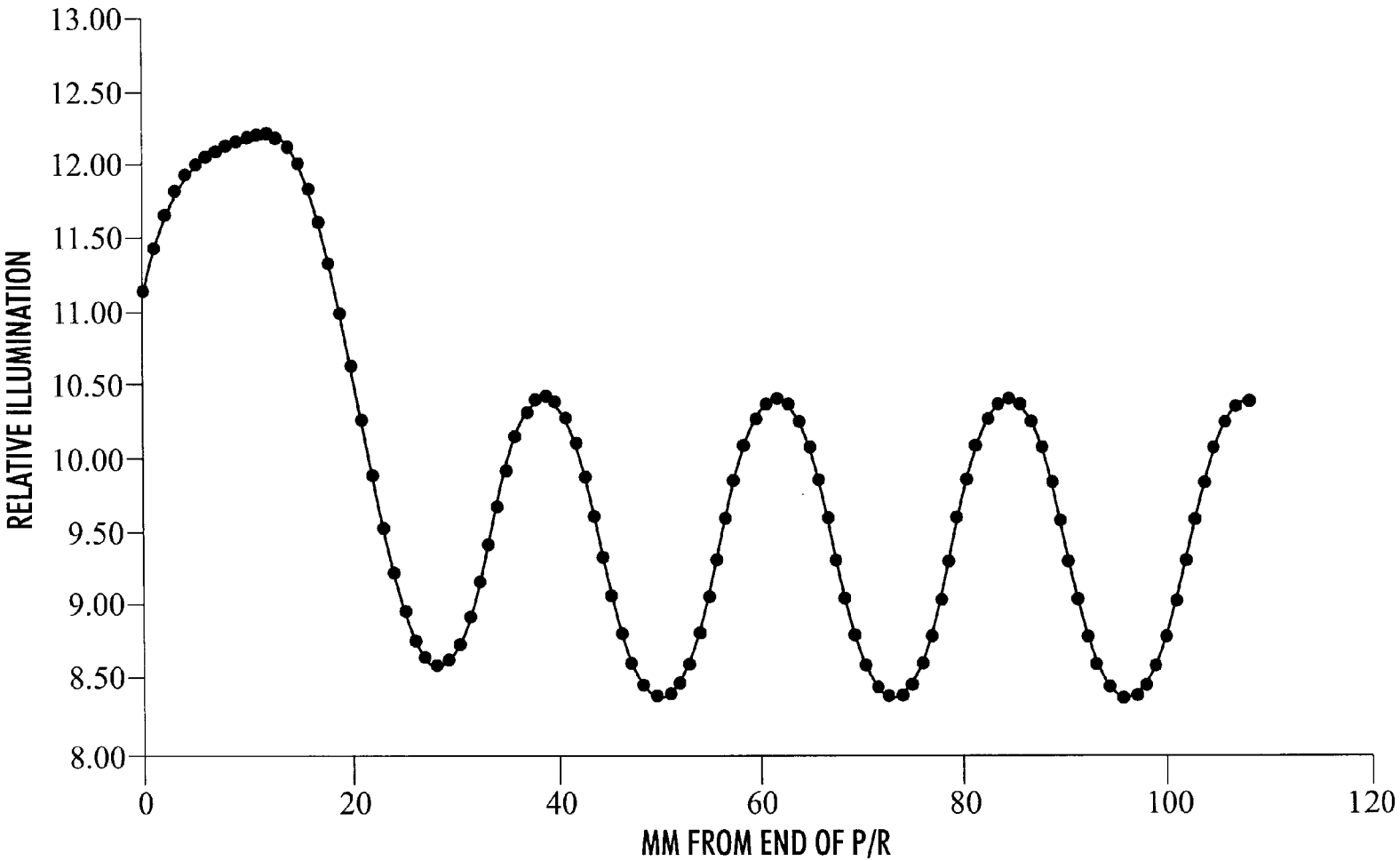

Table 3 outlines the general specifications usable to obtain the total light intensity curve as shown in FIG. 8.

TABLE 3

| X@P/R | S1 0 | S2 16.0 | S3 39.0 | S4 62.0 | S5 85.0 | S6 108.0 | S7 131.0 | S11 216.0 | E(x) |
|---|---|---|---|---|---|---|---|---|---|
| 0 | 8.87 | 2.20 | 0.06 | 0.00 | 0.00 | 0.00 | 0.00 | 0.00 | 11.134 |
| 1 | 8.81 | 2.54 | 0.07 | 0.00 | 0.00 | 0.00 | 0.00 | 0.00 | 11.428 |
| 2 | 8.64 | 2.92 | 0.08 | 0.00 | 0.00 | 0.00 | 0.00 | 0.00 | 11.652 |
| 3 | 8.36 | 3.35 | 0.10 | 0.00 | 0.00 | 0.00 | 0.00 | 0.00 | 11.815 |
| 4 | 8.00 | 3.81 | 0.11 | 0.01 | 0.00 | 0.00 | 0.00 | 0.00 | 11.927 |
| 105 | 0.00 | 0.00 | 0.00 | 0.04 | 1.20 | 8.36 | 0.46 | 0.00 | 10.076 |
| 106 | 0.00 | 0.00 | 0.00 | 0.03 | 1.02 | 8.64 | 0.54 | 0.00 | 10.255 |
| 107 | 0.00 | 0.00 | 0.00 | 0.03 | 0.87 | 8.81 | 0.63 | 0.00 | 10.368 |
| 108 | 0.00 | 0.00 | 0.00 | 0.02 | 0.74 | 8.87 | 0.74 | 0.00 | 10.406 |

General Specifications for the Sample Light Intensity Output According to this Invention As shown in Table 3, using e.g. (3), the design specifications for the light intensity output uses a 30° lens, where j=4.8, the relative output on the axis compared to the same LED without lens (M) to be 1, and 11 (N) point light sources at a variable spacing, where the space between the edge and the edge-adjacent light source is 16 mm and the curve space is 23 mm and the light sources are placed at a distance of 24.40 mm (R) away from the photoreceptor. As should be appreciated, with the above spacing a maximum/minimum ratio between the highest light intensity and lowest light intensity is 1.72. Thus, FIG. 8 illustrates the improvements obtainable using a variable spacing pre-charge erase array system according to this invention.

Figure 9:
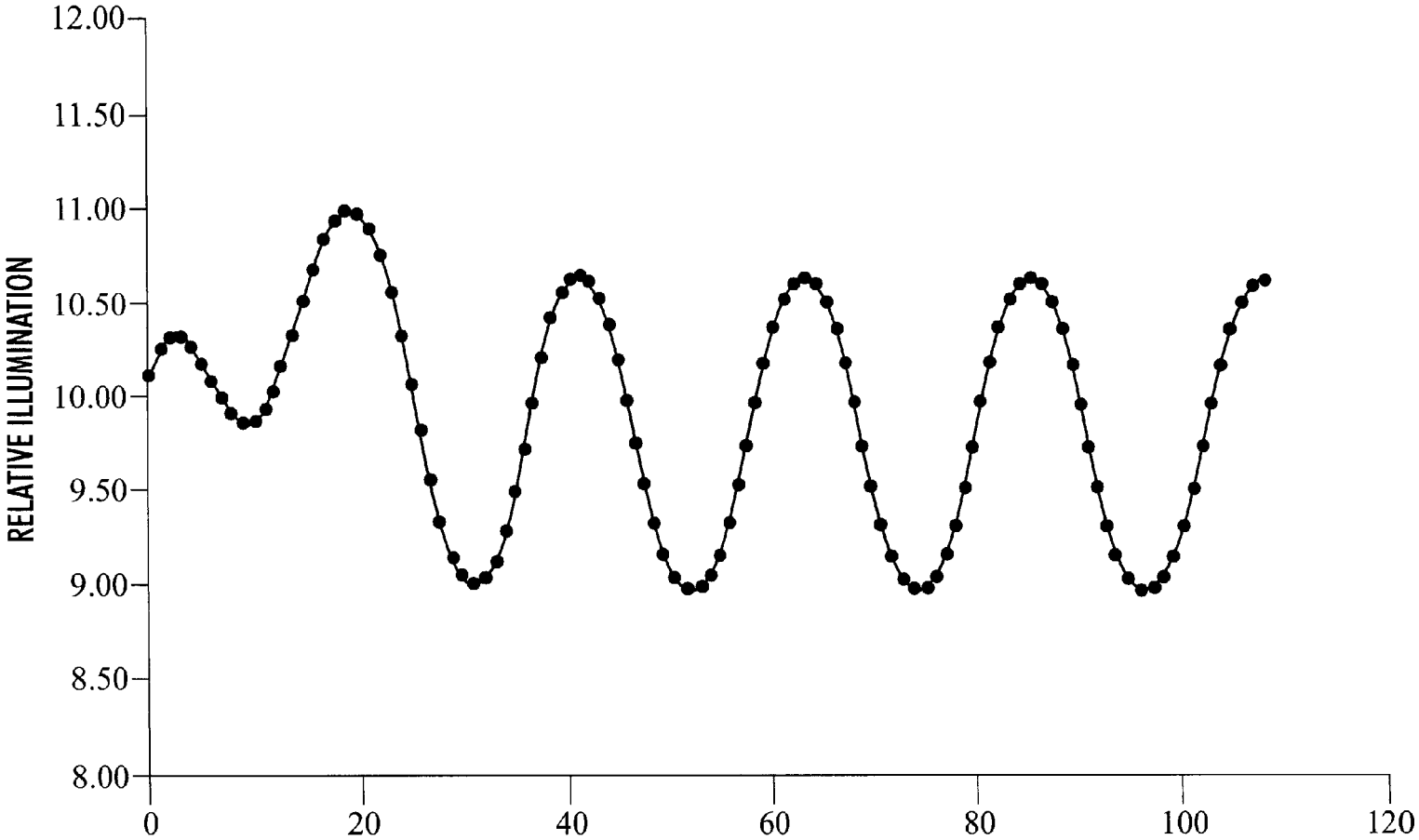
Figure 10:
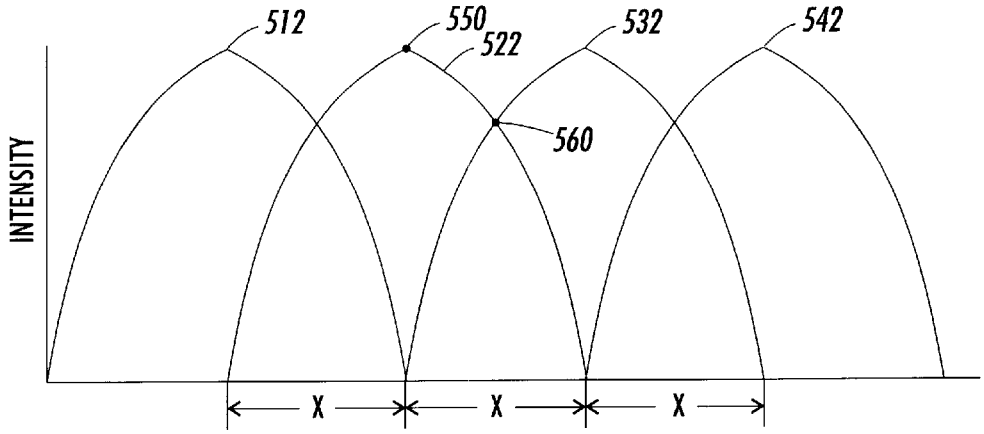
FIG. 10 RELATED ART
FIG. 10 a graph illustrating the light intensity from a plurality of light sources along the photoreceptor for a conventional pre-charge erase system.
Figure 11:
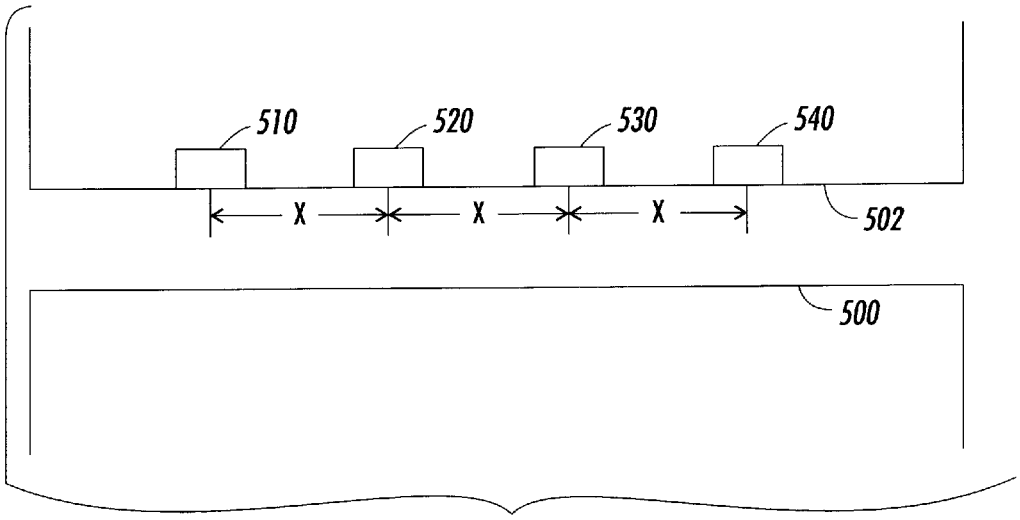
FIG. 11 RELATED ART
FIG. 11 shows a plurality of light sources placed adjacent to a photoreceptor in a conventional pre-charge erase system.

Table 4 outlines the general specifications usable to obtain the total light intensity curve as shown in FIG. 9.

TABLE 4

| X@P/R | S1 0 | S2 20.0 | S3 42.0 | S4 64.0 | S5 86.0 | S6 108.0 | S7 130.0 | S11 216.0 | E(x) |
|---|---|---|---|---|---|---|---|---|---|
| 0 | 8.87 | 1.20 | 0.04 | 0.00 | 0.00 | 0.00 | 0.00 | 0.00 | 10.108 |
| 1 | 8.81 | 1.40 | 0.05 | 0.00 | 0.00 | 0.00 | 0.00 | 0.00 | 10.258 |
| 2 | 8.64 | 1.63 | 0.05 | 0.00 | 0.00 | 0.00 | 0.00 | 0.00 | 10.328 |
| 3 | 8.36 | 1.90 | 0.06 | 0.00 | 0.00 | 0.00 | 0.00 | 0.00 | 10.327 |
| 105 | 0.00 | 0.00 | 0.00 | 0.05 | 1.40 | 8.36 | 0.54 | 0.00 | 10.375 |
| 106 | 0.00 | 0.00 | 0.00 | 0.04 | 1.20 | 8.64 | 0.63 | 0.00 | 10.539 |
| 107 | 0.00 | 0.00 | 0.00 | 0.04 | 1.02 | 8.81 | 0.74 | 0.00 | 10.643 |
| 108 | 0.00 | 0.00 | 0.00 | 0.03 | 0.87 | 8.87 | 0.87 | 0.00 | 10.679 |

General Specifications for the Sample Light Intensity Output According to this Invention As shown by Table 4, using e.g., (3), the design specification for the light intensity requires a 30° lens, where j=4.8, the relative output on the axis compared to the same LED without lens (M) to be 1, and 11 (N) point light sources at a variable pitch wherein the edge spacing between the edge and the edge-adjacent light sources is 20 mm, the interior spacing between light sources is 22 mm and the point light sources are placed at a distance of 24.40 mm (R) away from the photoreceptor. As should be appreciated, with the above spacing a maximum/minimum ratio between the highest light intensity and lowest light intensity is 1.23. Thus, FIG. 9 illustrates the improvements obtainable using a variable spacing pre-charge erase array system according to this invention.

The controller, 112, 212 and/or 312 shown in FIGS. 1–3, if implemented as an independent control device, can be implemented using a programmed microprocessor or microcontroller and peripheral integrated circuit elements, and ASIC or other integrated circuit, a digital signal processor, a hardwired electronic or a logic circuit such as a discrete element circuit, a programmable logic device such as a PLV, PLA, FPGA or PAL or the like. In other exemplary embodiments, where the controllers 112, 212 and/or 312 are implemented as part of the control system of the image forming system 100, 200 and/or 300 in which the pre-charge erase array system 110, 210 or 310 is implemented, the controllers 112, 212 and/or 312 can be implemented using a programmed general purpose computer or any other device capable of implementing the general control system for the image forming system. Such other devices include a special purpose computer, a programmed microprocessor or microcontroller and peripheral integrated circuit elements, and ASIC or other integrated circuit, a digital signal processor, a hardwired electronic or logic circuit such as discrete element circuit, a programmable logic device such as a PLV, PLA, FPGA or PAL or the like.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An image forming system, comprising:

a pre-charge erase array system usable to discharge charges present on a photoreceptor, the pre-charge erase array system comprises a plurality of point light sources that emit light onto the photoreceptor, the plurality of point light sources variably spaced to substantially uniformly illuminate the photoreceptor.

2. The image forming system of claim 1, wherein the plurality of point light sources are at least one of light emitting diodes and laser diodes.

3. The image forming system of claim 1, wherein a ratio of a maximum light intensity to minimum light intensity placed on the photoreceptor by the pre-charge erase array system is less than 2.0.

4. The image forming system of claim 1, wherein the variable spacing of the plurality of point light sources is determined based on a light intensity placed on the photoreceptor by a single light source.

5. The image forming system of claim 4, wherein a light intensity from a point light source is determined by the following expression:

$$E:(x,y,z)=B \text{ Cos } \alpha_i \text{ Cos } \beta_i/R_i^2$$

where:

B is the brightness of the point light source;

$\alpha$ is the angle between the surface normal to the photoreceptor and the vector to the point light source;

$\beta$ is the angle between the surface normal to the point light source and the vector to the photoreceptor;

i is the ith source illuminating the surface; and

R is the distance from the point light source to the photoreceptor.

6. The image forming system of claim 4, wherein the light intensity from a point light source to the photoreceptor when the point light source and the photoreceptor are parallel such that the photoreceptor surface normal passes through the point light source is:

$$E(x)=NB\Sigma \text{ Cos}^2 \alpha_i/R_i^2$$

where:

N is equal to the number of point light sources located within the pre-charge erase array system;

B is the brightness of the point light source;

$\alpha_i$ is equal to Arctan[$(x_i-x)/K$];

K is equal to the separation between the point light source and the photoreceptor;

$x_i$ is equal to the lateral offset between point x on the photoreceptor and the ith point light source; and $1/R_i$ is equal to the Cos $\alpha_i/K$.

7. The image forming system of claim 4, wherein the light intensity from a point light source to the photoreceptor when the point light source and the photoreceptor are parallel such that the photoreceptor surface normal passes through the point light source, and while using a lens, is:

$$E(x)=MNB\Sigma \text{ Cos}^{j} \alpha_i \text{ Cos } \beta_i/R_i^2$$

where:

M is equal to the on-axis output relative to the same point light source without the lens;

N is equal to the number of point light sources located within the pre-charge erase array system;

B is the brightness of the point light source;

$\text{Cos}^{j} \alpha_i$ is a power function that approximates an output profile so that a 50% output matches a specified angle;

$\text{Cos } \beta_i$ is an angle between the surface normal to the point light source and a vector to the photoreceptor; and R is the distance from the point light source to the photoreceptor.

8. A method for placing a band of light from a plurality of point light sources onto a photoreceptor, comprising:

determining an amount of light placed by a single point light source onto the photoreceptor; and variably spacing the plurality of point light sources such that the band of light substantially uniformly illuminates the photoreceptor.

9. The method of claim 8, wherein the plurality of point light sources are at least one of light emitting diodes and laser diodes.

10. The method of claim 8, wherein a ratio of a maximum light intensity to minimum light intensity within the band of light placed on the photoreceptor is less than 2.0.

11. The method of claim 8, wherein the amount of light from the point light source is:

$$E:(x,y,z)=B \text{ Cos } \alpha_i \text{ Cos } \beta_i/R_i^2$$

where:

B is the brightness of the point light source;

$\alpha$ is the angle between the surface normal to the photoreceptor and the vector to the point light source;

$\beta$ is the angle between the surface normal to the point light source and the vector to the photoreceptor;

i is the ith source illuminating the surface; and

R is the distance from the point light source to the photoreceptor.

12. The method of claim 8, wherein the amount of light from the point light source to the photoreceptor when the point light source and the photoreceptor are parallel such that the photoreceptor surface normal passes through the point light source is:

$$E(x)=NB\Sigma \text{ Cos}^2 \alpha_i/R_i^2$$

where:

N is equal to the number of point light sources located within the pre-charge erase array system;

B is the brightness of the point light source;

$\alpha_i$ is equal to $\text{Arctan}[(x_i-x)/K]$;

K is equal to the separation between the point light source and the photoreceptor;

$x_i$ is equal to the lateral offset between point x on the photoreceptor and the ith point light source; and $1/R_i$ is equal to the $\text{Cos } \alpha_i/K$.

13. The method of claim 8, wherein the amount of light from the point light source to the photoreceptor when the point light source and the photoreceptor are parallel such that the photoreceptor surface normal passes through the point light source and while using a lens is:

$$E(x)=MNB\Sigma \text{ Cos}^{i} \alpha_i \text{ Cos } \beta_i/R_i^2$$

where

M is equal to the on-axis output relative to the same point light source without the lens;

N is equal to the number of point light sources located within the pre-charge erase array system;

B is the brightness of the point light source;

$\text{Cos}^{i} \alpha_i$ is a power function that approximates an output profile so that a 50% output matches a specified angle;

$\text{Cos } \beta_i$ is angle between the surface normal to the point light source and a vector to the photoreceptor; and R is the distance from the point light source to the photoreceptor.

* * * * *